US007849611B2

(12) United States Patent
Dean

(10) Patent No.: US 7,849,611 B2
(45) Date of Patent: Dec. 14, 2010

(54) SHOE WITH SYSTEM FOR PREVENTING OR LIMITING ANKLE SPRAINS

(76) Inventor: Christopher N. Dean, 560 W. Ashby Dr., Meridian, ID (US) 83646

( * ) Notice: Subject to any disclaimer, the term of this patent is extended or adjusted under 35 U.S.C. 154(b) by 741 days.

(21) Appl. No.: 11/762,764

(22) Filed: Jun. 13, 2007

(65) Prior Publication Data

US 2008/0307674 A1 Dec. 18, 2008

(51) Int. Cl.
*A43B 7/20* (2006.01)
*A43B 23/08* (2006.01)

(52) U.S. Cl. ..... 36/89; 36/114

(58) Field of Classification Search ..... 36/89, 36/140, 141, 142, 88, 72 R, 92, 115; 602/27
See application file for complete search history.

(56) References Cited

U.S. PATENT DOCUMENTS

| | | | | | |
|---|---|---|---|---|---|
| 2,444,428 | A | * | 7/1948 | Carrier | 36/99 |
| 2,918,734 | A | * | 12/1959 | Hyde | 36/89 |
| 2,972,822 | A | * | 2/1961 | Tanner | 36/89 |
| 3,659,361 | A | * | 5/1972 | White, Sr. | 36/89 |
| 4,263,728 | A | | 4/1981 | Frecentese | 36/129 |
| 4,296,557 | A | | 10/1981 | Pajevic | 36/7.8 |
| 4,346,525 | A | | 8/1982 | Larsen et al. | 36/69 |
| 4,361,971 | A | | 12/1982 | Bowerman | 36/129 |
| 4,472,890 | A | | 9/1984 | Gilbert | 36/28 |
| 4,550,511 | A | | 11/1985 | Gamm | 36/50 |
| 4,624,062 | A | | 11/1986 | Autry | 36/32 R |
| 4,631,841 | A | | 12/1986 | Hickey | 36/43 |
| 4,670,995 | A | | 6/1987 | Huang | 36/29 |
| 4,709,489 | A | | 12/1987 | Welter | 36/27 |
| 4,715,130 | A | | 12/1987 | Scatena | 36/27 |
| 4,731,939 | A | | 3/1988 | Parracho et al. | 36/31 |
| 4,747,410 | A | | 5/1988 | Cohen | 128/581 |
| 4,779,359 | A | | 10/1988 | Famolare, Jr. | 36/29 |
| 4,843,735 | A | | 7/1989 | Nakanishi | 36/28 |
| 4,856,208 | A | | 8/1989 | Zaccaro | 36/29 |
| 4,894,933 | A | | 1/1990 | Tonkel et al. | 36/28 |

(Continued)

OTHER PUBLICATIONS

Ricard, et al.; "Effects of High-Top and Low-Top Shoes on Ankle Inversion"; *Journal of Athletic Training*; 2000;35(1):38-43, by the National Athletic Trainers' Association, Inc.

*Primary Examiner*—Jila M Mohandesi
(74) *Attorney, Agent, or Firm*—Pedersen and Company, PLLC; Ken J. Pedersen; Barbara S. Pedersen

(57) ABSTRACT

A built-in or added-on extension is situated upon a side of a shoe so as to minimize or prevent injury caused by inversion of a foot/ankle during athletic or other activities. The extension protrudes laterally out from the side of the shoe and has a substantial horizontal component, with an outer surface portion(s) adapted in shape, size, and/or placement so that said portion(s) will impact the floor/ground upon inversion of the foot/ankle but that none of the extension impacts, rubs, slides, or otherwise contacts the ground/floor during normal activities of the wearer. Said impact/contact only occurs when there is significant ankle/foot inversion, that is, enough to potentially cause a mild lateral ankle sprain. The preferred extension cushions and/or stops inversion at an angle of inversion and/or at a time during the inversion wherein the wearer may recover and straighten his foot/ankle before serious injury to the ankle.

10 Claims, 4 Drawing Sheets

U.S. PATENT DOCUMENTS 4,910,886 A 3/1990 Sullivan et al. ..... 36/44
4,936,029 A 6/1990 Rudy ..... 36/29
4,972,611 A 11/1990 Swartz et al. ..... 36/28
4,999,931 A 3/1991 Vermeulen ..... 36/29
5,005,300 A 4/1991 Diaz et al. ..... 36/114
5,042,176 A 8/1991 Rudy ..... 36/29
5,046,267 A 9/1991 Kilgore et al. ..... 36/114
5,067,255 A 11/1991 Hutcheson ..... 36/43
5,109,613 A 5/1992 Van Dyke ..... 36/89
5,131,174 A 7/1992 Drew et al. ..... 36/35 B
5,174,049 A 12/1992 Flemming ..... 36/28
5,224,278 A 7/1993 Jeon ..... 36/29
5,245,766 A 9/1993 Warren ..... 36/29
5,297,349 A 3/1994 Kilgore ..... 36/114
RE34,661 E 7/1994 Grim ..... 602/27
5,335,382 A 8/1994 Huang ..... 5/454
5,381,607 A 1/1995 Sussmann ..... 36/28
5,406,719 A 4/1995 Potter ..... 36/28
5,440,826 A 8/1995 Whatley ..... 36/25 R
RE35,113 E 12/1995 Grim ..... 602/14
5,493,792 A 2/1996 Bates et al. ..... 36/28
5,566,478 A 10/1996 Forrester ..... 36/134
5,657,767 A 8/1997 Nelson et al. ..... 128/882
5,669,161 A 9/1997 Huang ..... 36/43
5,713,141 A 2/1998 Mitchell et al. ..... 36/27
5,718,063 A 2/1998 Yamashita et al. ..... 36/28
5,771,606 A 6/1998 Litchfield et al. ..... 36/29
5,782,014 A 7/1998 Peterson ..... 36/38
5,806,209 A 9/1998 Crowley et al. ..... 36/28
5,815,949 A 10/1998 Sessa ..... 36/3 B
5,830,553 A 11/1998 Huang ..... 428/72
5,875,569 A 3/1999 Dupree ..... 36/103
5,952,065 A 9/1999 Mitchell et al. ..... 428/35.4
D416,381 S 11/1999 Senda et al. ..... D2/961
6,026,593 A 2/2000 Harmon-Weiss et al. ..... 36/28
6,038,790 A 3/2000 Pyle et al. ..... 36/30 R
6,061,928 A 5/2000 Nichols ..... 36/28
6,079,128 A * 6/2000 Hoshizaki et al. ..... 36/89
6,115,945 A 9/2000 Ellis, III ..... 36/102
6,145,220 A 11/2000 Johnson, Jr. et al. ..... 36/34 R
6,163,982 A 12/2000 Ellis, III ..... 36/25 R
6,205,682 B1 3/2001 Park ..... 36/29
6,253,466 B1 7/2001 Harmon-Weiss et al. ..... 36/28
6,314,663 B1 11/2001 Saldana ..... 36/28
6,354,020 B1 3/2002 Kimball et al. ..... 36/29
6,393,731 B1 5/2002 Moua et al. ..... 36/27
6,430,843 B1 8/2002 Potter et al. ..... 36/29
6,453,577 B1 9/2002 Litchfield et al. ..... 36/29
6,505,420 B1 1/2003 Litchfield et al. ..... 36/29
6,508,017 B1 1/2003 DeBarro et al. ..... 36/28
6,521,305 B1 2/2003 Mitchell et al. ..... 428/35.4
6,557,271 B1 5/2003 Weaver, III ..... 36/27
6,618,959 B1 9/2003 Sussmann ..... 36/29
6,662,470 B2 12/2003 Ellis, III ..... 36/25 R
6,701,645 B1 3/2004 Forrester ..... 36/134
6,715,218 B2 * 4/2004 Johnson ..... 36/89
6,775,929 B2 8/2004 Katz et al. ..... 37/88
6,775,930 B2 8/2004 Fuerst ..... 36/103
6,802,138 B2 10/2004 McManus et al. ..... 36/28
6,845,573 B2 1/2005 Litchfield et al. ..... 36/29
6,886,275 B1 5/2005 Westfall ..... 36/133
6,964,119 B2 11/2005 Weaver, III ..... 36/27
7,007,356 B2 3/2006 Cudney et al. ..... 29/91.1
7,020,989 B2 * 4/2006 Kim ..... 36/89
7,080,467 B2 7/2006 Marvin et al. ..... 36/29
7,082,699 B2 8/2006 Nishiwaki et al. ..... 36/28
7,096,602 B2 8/2006 Palmer et al. ..... 36/12
7,140,124 B2 11/2006 Manz et al. ..... 36/25 R
2003/0188455 A1 10/2003 Weaver, III ..... 36/27
2004/0088887 A1 * 5/2004 Kim ..... 36/89
2005/0108896 A1 5/2005 Preskar et al. ..... 36/27
2006/0059714 A1 3/2006 Harmon-Weiss et al. .... 36/35 B
2006/0059719 A1 * 3/2006 Lebo ..... 36/89
2006/0137226 A1 6/2006 Jung et al. ..... 36/89
2006/0234012 A1 10/2006 Wang ..... 428/188
2007/0056189 A1 * 3/2007 Schafer Mathison ..... 36/89
2007/0068046 A1 3/2007 Mathieu et al. ..... 36/102

* cited by examiner

SHOE WITH SYSTEM FOR PREVENTING OR LIMITING ANKLE SPRAINS

BACKGROUND OF THE INVENTION

1. Field of the Invention

The present invention relates generally to shoes, and, more specifically, to athletic or recreation shoes that comprise a system for preventing serious ankle sprains. Preferred embodiments of the invention comprise an extension that protrudes from the shoe, near the wearer's ankle, to an extent that, when the wearer's foot and ankle begin to invert, the extension impacts the floor or ground to limit or prevent further inversion. Thus, the preferred extension is positioned and sized to prevent serious ankle sprains, but does not impede mobility.

2. Related Art

Ankle sprains are reported to be the cause of approximately 7-10% of all emergency room visits. Ankle sprains are the most common sports injury, and are estimated to be 10-21% of all sports injuries. Athletes participating in basketball, volleyball, soccer, and football are at especially high risk for ankle sprains, which are estimated to be 25-45% of injuries in these sports.

Inversion, eversion, supination, and pronation are events/actions that primarily occur at the subtalar joint. Inversion may be described as the inward turning of the sole of the foot, and eversion may be described as the outward turning of the sole of the foot. Supination is a combination of calcaneal inversion, foot adduction (moving of a body part toward the central axis of the body), and plantar flexion. Pronation is a combination of calcaneal eversion, foot abduction (to draw away from the central axis of the body), and dorsiflexion. Therefore, the events/actions that will be limited or remedied by preferred embodiments of the invention will fall under the categories of inversion or supination.

The most common ankle injury is a lateral sprain caused by inversion of the foot, which is the turning inward of the foot relative to its natural position wherein the sole of the foot is substantially flat on a horizontal surface and the plane through the center of the heel (parallel to the length of the foot) is vertical. Lateral ankle sprains are also referred to as "inversion," or sometimes "supination," ankle sprains, and the motion that results in said sprains is often referred to as "foot inversion" and sometimes also "ankle inversion". It has been reported that 85% percent of ankle injuries are sprains, and 85% of those are lateral sprains. More than approximately 25,000 lateral ankle sprains are believed to occur each day in the United States.

The most common mechanism of ankle injury is an athlete who "rolls" over the outside of his or her ankle, "turning" his/her ankle and injuring the lateral-ligament complex by stretching or tearing the ligaments, with the result being an "ankle sprain." This usually occurs as either a non-contact injury, or when the athlete lands from a step or jumps onto an opponent's foot with an inverted foot. The foot is usually plantar-flexed at the time of such an injury.

Because the inner ankle is more stable than the outer ankle, the foot is likely to turn inward (foot inversion) from a fall, tackle, or jump. Therefore, athletes who jump during their sport therefore are at high risk for ankle sprains because they can accidentally land on the side of their foot, or because they can accidentally land on another player's foot. Extensive running, exercise, or training also can overstress the ligaments, leading to injury. Contact and kicking sports expose the foot and ankle to potential trauma-direct blows, crushing, displacement, etc. Sprains are especially prevalent in football, hockey, and soccer, wherein trauma to the ankle can dislocate a joint, fracture a bone, stretch or tear ligaments, or strain muscles and tendons.

In barefoot conditions, the ankle and foot normally avoid an external inverting torque because the line of action of the reaction force is seldom far from the subtalar axis. A shoe may make the foot more vulnerable to hyperinversion because the added breadth/thickness of the shoe increases the length of the lever aim that, in effect, allows/causes the force acting on the foot to invert the foot. Further, the friction between the shoe and the ground adds a shear (horizontal)-force component, thus creating more torque about the subtalar joint. In a traumatic situation, an external inversion torque typically starts the mechanism of injury. If the evertor muscles cannot counteract the external inversion torque, hyperinversion resulting in trauma to the lateral ankle ligaments is likely to occur.

The bony and soft tissue anatomy of the ankle places the lateral side of the ankle at higher risk than the medial side. The distal end of the fibula (ie, the lateral malleolus) extends further inferiorly than the distal end of the tibia (ie, the medial malleolus). This discrepancy in length gives the medial ankle superior stability by improving bony resistance to eversion (outward movement of foot relative to its normal position, as opposed to the inward movement of the foot in inversion).

Although athletes usually recover quickly from ankle sprains, failure to rehabilitate appropriately imposes an increased risk for future injury. The first time a person sustains a sprain, the ligaments are stretched and typically the person will be more prone to "lateral ankle instability" and future ankle sprains. Such a person typically needs a brace for support or surgery to repair the ligaments. Therefore, the most common predisposition to suffering a lateral ankle sprain is the history of at least one previous ankle sprain. In sports such as basketball, recurrence rates have been reported to exceed 70%. Repetitive sprains have also been linked to increased risk of osteoarthritis and articular degeneration at the ankle.

A factor in determining whether a sprain will occur, and how severe the sprain will be, is the rate and magnitude of "loading" on the foot and/or ankle, which may also be described as the rate of application of the force and the amount of overall external force to which the foot/ankle is subjected during the event (typically, an outward force). Another factor, as discussed elsewhere in this document, is the overall health and strength of the foot and ankle, and the associated ligaments and muscles, which may determine the speed and strength with which the said foot, ankle, ligaments and muscles resist the externally applied forces. The response to the rate of loading, the rate of inversion, and the ability of the human body to react, compensate, and correct the inversion, are all interrelated factors in determining the severity of the resulting injury. In simple terms, when the rate of loading and the rate of inversion are fast, the body has less time to react, resulting in increased inversion and probably in increased injury. Also, if the human body is slower and/or weaker in its reaction, because of innate ability, age, or previous injuries, increased inversion and probably increased injury will result.

A discussion of rate of loading and rate of inversion, and the effects of shoe type, is presented in Ricard, et al. "Effects of High-Top and Low-Top Shoes on Ankle Inversion." Journal of Athletic Training. 2000: 35(1); 38-43. As suggested by this article, high-top shoes may be effective in reducing the amount and rate of inversion. Also, wrapping, braces, or other reinforcements may be effective in reducing the amount and rate of inversion, but, in the inventor's opinion, said reinforcements may also reduce mobility of the wearer.

Shoes with stabilizing features, or broadened soles, are described in the patent literature. Examples include Katz, et al. (U.S. Pat. No. 6,775,929, issued Aug. 17, 2004) discloses a stabilization device for a shoe that comprises small lateral bumpers, which extend from the sole of the shoe, at or very near to the plane of the bottom of the sole. Dupree (U.S. Pat. No. 5,875,569, issued Mar. 2, 1999) discloses a small "wing" that extends outwardly from the lateral side of the sole of the shoe between the ankle and the ball of the user's foot, wherein the wing is very near to the bottom of the sole so that the wing contacts the floor/ground almost immediately upon the beginning of any inversion. Ellis, III (U.S. Pat. No. 6,163,982) and Mathieu, et al. (U.S. 2007/0068046 A1) disclose shoe soles that are broader than those considered normal and that may have some stabilizing effect. Weaver, III (U.S. Pat. No. 6,964,119) discloses spring members that extend from the shoe upper down to the plane of the sole, as a part of an energy storage system that Weaver describes as converting impact force generated by the user at the heel portion, due to natural walking or running motion, into propulsion forces to thereby enhance the user's performance.

There is still a need for a shoe that helps prevent foot/ankle inversions, or that helps lesson the seriousness of said foot/ankle inversions and the consequent injuries. The inventor believes that there is a need for such a shoe that also allows excellent mobility and comfort, to minimize or eliminate the anti-inversion system's interference with the sports or other activities of the wearer.

SUMMARY OF THE INVENTION

The present invention is comprised of a built-in or added-on extension so situated upon a side of a shoe so as to minimize or prevent injury caused by inversion of a foot/ankle during athletic or other activities. The invention may comprise the combination of a shoe and said extension, and/or the method of using such a combination. The preferred extension protrudes laterally out from the side of the shoe substantially horizontally, and with an outer surface portion(s) adapted in shape, size, and/or placement so that said portion(s) will impact the floor/ground upon inversion of the foot/ankle. The extension comprises little or no structure attached to, or extending to the level of, the shoe sole, so that the extension does not interfere with mobility of the wearer. The extension resides on the shoe significantly above the sole, and comes in contact with the floor or ground preferably only when the wearer's ankle/foot becomes inverted. The preferred extension is adapted so that said contact limits inversion to an amount that is not severely injuring to the wearer, by cushioning and/or stopping inversion at an angle of inversion and/or at a time during the inversion wherein the wearer may recover and straighten his foot and ankle before serious injury to the ankle.

When the foot of the wearer of the shoe is rotated with respect to the leg of the wearer, the extension mounted upon the side of the shoe makes contact with the floor before the foot and ankle can be inverted or "turned" to the point of being seriously sprained or broken. The extension is preferably slightly resilient or cushioning, so as to provide a firm and quick, but non-shocking and non-jolting, stopping of, or slowing of, the ankle/foot inversion. Having the extension comprise some cushioning characteristics allows the extension to cushion and dissipate the forces causing the ankle/foot to invert, to slow the "rate of loading" and the rate of inversion, discussed in the Related Art section above, and preferably to prevent the forces from continuing to turn or otherwise pivot/rotate the foot or ankle in a dangerous direction.

The preferred connection of the extension to, or preferred holder for the extension provided on, the shoe may be firm, rigid, or elastic, so that the extension is held tightly against the shoe upper and so as to prevent the extension from moving or sliding sideways on the shoe (forward or rearward relative to the foot) when the extension hits the floor/ground. Such firmness and certainty in the placement of the preferred extension, significantly above the sole of the shoe, will help maintain mobility, maneuverability, and agility of the wearer while he wears the shoes for sports or exercise, or even for everyday activities, and yet will provide the protection of limiting inversion during sports or other activities. An object of the present invention, therefore, is to maintain the wearer's mobility and his/her ability to move and react quickly in all directions, without the invention hindering said mobility and movement at all, or at least not to a significant extent. The preferred embodiments are a substantial distance above the sole, and especially a substantial distance above the plane of the bottom of the sole, so that said embodiments will be unlikely to impact, slide, rub, or abut against the floor, ground, or other playing surface except when there is an action or reaction that represents a serious inversion or an incipient sprain.

BRIEF DESCRIPTION OF THE DRAWINGS

The feet and shoes shown in the figures are right feet and shoes, as will be understood by the extensions being located on the right side of the shoe. Therefore, foot/ankle inversion will be understood to involve the foot rotating in a clockwise direction when viewed from the rear of the heel in FIGS. 3, 4, 6, and 7. Embodiments of the invention may be applied to left feet and left shoes, wherein the extension would protrude out to the left of the foot/shoe and the foot would invert by the sole of the foot rotating counterclockwise when viewed from the rear of the heel. In these positions, on the right and left surfaces of the right and left shoes, respectively, each extension will tend not to impact or abut into the wearer's other (opposite) extension, shoe, leg, foot, or ankle. Extensions according to some embodiments may also be placed on the inner surfaces of the shoes (left side of the right shoe, and right side of the left shoe), for example, to help prevent eversion, but this is less preferred as the extensions may abut each other and make agile movement difficult.

DESCRIPTION OF THE PREFERRED EMBODIMENTS

Figure 1:
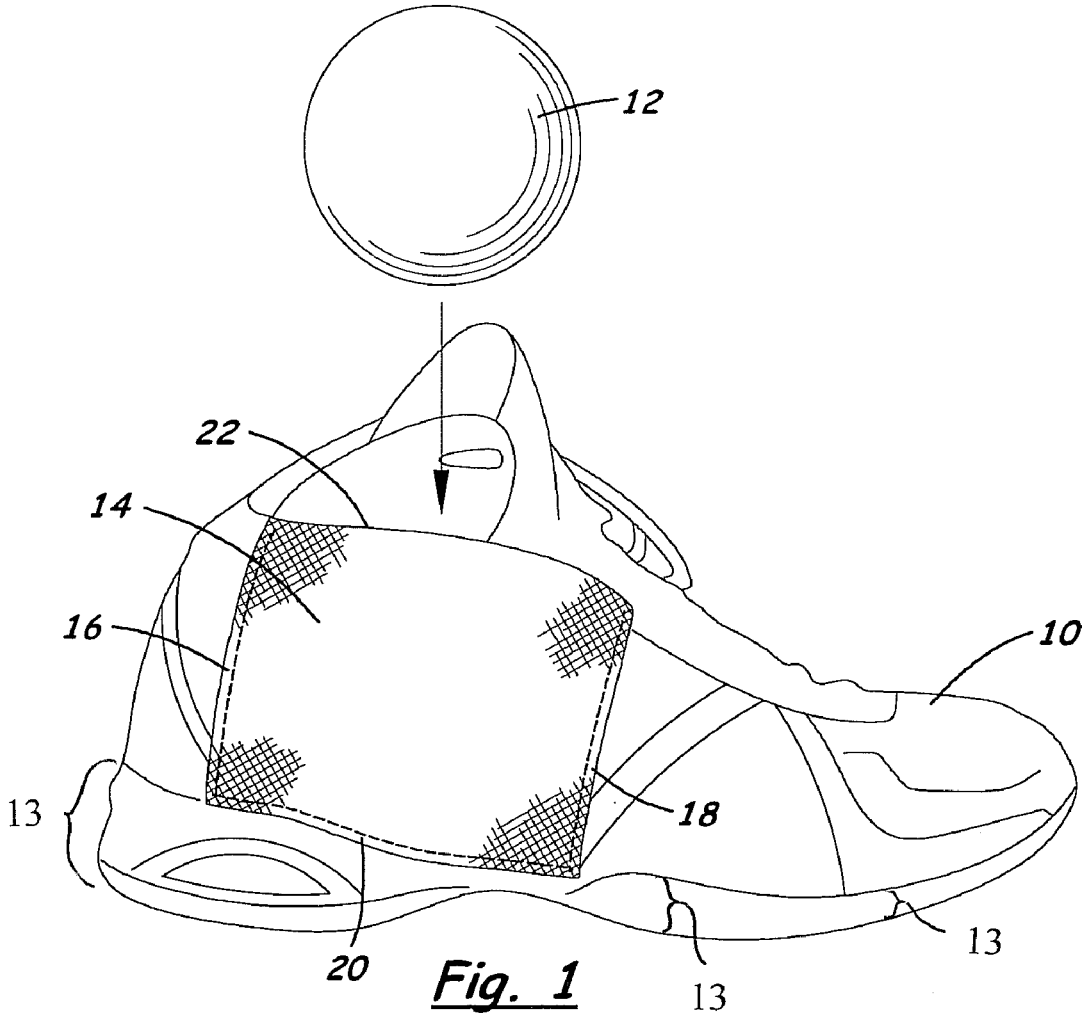
FIG. 1 is a side view according to one embodiment of the present invention, wherein one embodiment of the extension is shown. Said one embodiment comprises an insert that is spherical and that may be installed into one embodiment of a pouch on the side of the shoe upper, wherein the pouch in this figure is non-stretched and is resiliently collapsed against the side of the shoe upper.

Referring to the Figures, there are shown several, but not the only, embodiments of the invented extension device used to eliminate or reduce the potential for spraining or breaking of the ankle during athletic or other activities.

As discussed in the Related Art section and as is well known in the medical and sports medicine fields, a lateral ankle sprain is caused upon inversion of the foot/ankle, with the most severe occurring when the ankle "rolls over" to, or nearly to, the floor or ground. Ankle/foot inversion is usually defined by describing the amount of movement of the heel from its normal vertical position wherein the plane (P1 in FIG. 7, extending through the normally-vertical center of the heel and parallel to the longitudinal axis of the foot), is 90 degrees from the plane of the floor (angle D1 in FIG. 7), that is, the wearer is standing with feet "flat on the ground." In this situation, the plane of the bottom of the sole is parallel to, and extremely close to (touching) the floor plane, and so, in this disclosure, we can equate the plane of the bottom of the sole with the top of a flat floor/ground when the wearer is standing flat on the floor/ground. An inversion is any amount "past" 90 degrees, that is, the bottom plane of the right foot in FIG. 7 rotating clockwise in FIG. 7 (the right ankle typically moves to the right), so that angle D1 becomes more than 90 degrees and the angle D2 between P1 and the floor on the right of the foot in FIG. 7 becomes less than 90 degrees. In many discussions of the subject of ankle/foot inversion, it is angle D3 (see FIGS. 4 and 7) that is described as the angle or amount of inversion, that is, the angle that the foot rotates from the plane P1 being vertical. Thus, when an inversion is stated as being "from 20-40 degrees" or "30 degrees," for example, this means that D3 is 20-40 degrees, or 30 degrees, respectively. As discussed above in the Related Art section, inversion can cause minor ankle sprain, up to major ankle sprain, with the severity of the ankle sprain being dependent upon the individual, the outward body force and "rate of loading" (in FIG. 7, in the direction to the right), and the angle/extent and rate of inversion.

As the heel plane moves past 90 degrees (relative to the floor/ground) in an inversion (for example, D1=100 degrees, D2=80 degrees, D3=10 degrees), the first ligament to stretch or sustain injury is the anterior talofibular. As inversion continues, the next ligament to sustain injury is the calcancofibular ligament. If both of these ligaments are sprained, it is considered a grade 3 or 4 sprain. And in severe cases (though rare), the posterior talofibular ligament is torn.

Preferred embodiments of the invention allow some inversion, for example, up to an amount of inversion selected from a range that places the heel plane angle to the floor in the range of D1=110 to 135 degrees, and D2=70 to 45 degrees, and the inversion angle D3=20-45 degrees. This will cause stretching and may cause some injury of the ligaments, but preferably not to an extent that the injury may be called a grade 3 or 4 sprain or that the ankle will become broken. If the wearer uses embodiments of the invention to prevent serious sprains from an early age, or from the user's early career in a sport that is prone to creating sprains, the wearer may tend to retain healthier ankles that are less likely to be damaged in later inversions and/or that may be quicker to heal.

Referring now to FIGS. 1-4, it will be observed that one embodiment of the extension 1 comprises a generally spherically-shaped insert 12 that may be constructed of a firm but slightly resilient material, such as a firm foam or firm rubber or neoprene. Firmness and resiliency the same or similar to that of a polystyrene foam sphere, a firm rubber ball, a closed cell foam member, or an inflated, hollow, polymer sphere are desirable. Preferably, the extension is light weight so that it adds little weight to the shoe on which it is supplied. Many different shapes and materials, both hollow or solid, may be effective in providing firmness and cushioning, with the preferred goal being that impact of the extension against the floor/ground, as the ankle inverts, is cushioned by a fraction of a second of elastic/plastic cushioning of the impact, followed by either such definite slowing, or such definite stopping, of the motion of the shoe and foot toward the floor that injury is limited or stopped until the human body can recover a safer position and orientation. The extension may therefore comprise a member selected from the group consisting of, for example, a polystyrene foam sphere, a solid rubber ball, a hollow rubber ball, a closed cell foam member, a solid cylinder, a hollow cylinder, a solid rounded-end cone, a hollow rounded-end cone, a solid partial sphere, and a hollow partial sphere, a hollow member connected to the shoe upper and containing gas at a pressure higher than the atmosphere around the shoe (discussed later in this disclosure), and a hollow pocket in an upper of the shoe containing gas at a pressure higher than the atmosphere around the shoe (discussed later in this disclosure), and/or other shapes and forms.

The insert 12 may be inserted into, and captured within, a pocket 14 attached to the generally vertical side 11 of athletic shoe 10, preferably said side 11 being a portion of the shoe upper that is directly below, or alternatively at the bottom end of, the fibula and generally centered on the portion that would be considered at the side of the heel.

Pocket 14 is preferably constructed of material having elasticity sufficient to retain insert 12 within pocket 14 in a fixed position on/adjacent to vertical side 11 of shoe 10, so that the insert 12 does not shift any significant amount on the shoe during walking, running, or other normal movement, and also does not shift a significant amount on the shoe during the impact against the floor/ground upon inversion of the ankle.

Pocket 14 may be attached to shoe 10 with adhesives and/or stitching at side edges 16 and 18 and at bottom edge 20, or otherwise attached to, or integrally extending from, the material of the upper. For embodiments wherein the insert may be easily removed and replaced, pocket 14 is preferably not attached to the shoe 10 at top edge 22, thereby leaving an opening into which the insert 12 is installed. The elasticity of the pocket 14 material may be used to effectively close the pocket around the insert 12, or pocket 14 may also employ hook and loop material at top edge 22 (not shown), or another closure system, to secure top edge 22 to shoe 10 to further enhance the capability of pocket 14 to retain the insert 12.

Figure 2:
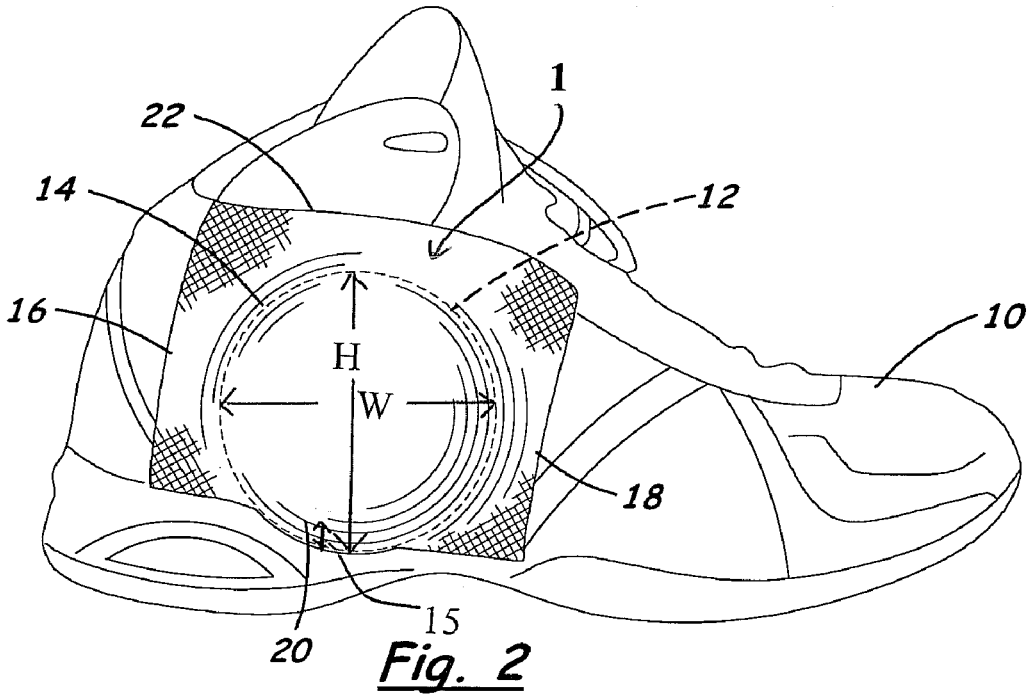
FIG. 2 is a side view of the embodiment of FIG. 1, wherein the insert has been inserted into the pouch, and the material of the pouch is stretched to firmly and tightly hold said insert.

As may be seen to best advantage in FIG. 2, the extension 1 is preferably centered on the upper of the shoe in the rearward ½ of the shoe upper. The extension 1 foremost extent (or "forward extremity") preferably is located at or slightly behind a vertical plane passing through the middle of the arch of the shoe/foot and transverse to the length of the foot. The extension rearmost extent ("rearward extremity) preferably is located slightly forward of the back of the shoe (that is, the rearmost surface of the heel of the shoe). The pouch, or other attachment/connection means for the insert, is preferably entirely attached to, and located on, the upper of the shoe, rather than the sole.

The sole 13 of the shoe in FIGS. 1-7 is the portion of the shoe that is formed as the platform upon which the wearer stands, with the shoe upper extending upward from the sole to surround or contain the foot. The term "sole of the shoe" in this disclosure, therefore, includes the sole structures that have some portion this is visible from the outside of the shoe, that it, the outsole (which is the portion of the shoe that contacts the floor/ground) plus the heel. The insole, which is the relatively thin pad or layer inside the shoe upon which the foot is placed, is not visible from the outside of the shoe and is not included in this disclosure's definition of "sole"; one of skill in the art will understand the location and relationship of the preferred extensions to the insole, however, as the insole is typically a thin pad/layer that rests on/near the outsole and the heel and it is relatively thin compared to the outsole and heel (especially in modern sport/recreation shoes). In many modern shoes, the outsole is molded so that its top surface is slightly concave and the outer perimeter edge of the outsole extends slightly Lip above the central region of the outsole that is inside the shoe and upon which the insole rests. Therefore, the top plane SP of the sole of the shoe in the heel area (as defined in FIG. 3 by the plane passing through the connection/intersection SU visible on the outside of the shoe between the sole and the upper), may be slightly above the top surface of the insole depending upon the thickness of the insole. In many modern sport and recreation shoes, there is little, if any, differentiation between the heel and the rest of the outsole except the heel is typically the thickness portion of the sole, whereas there is typically more differentiation in more traditional shoes, as will be understood by one of skill in the art. Still, whatever the shape and structure of the outsole and its heel, it will be understood by one of skill in the art how to differentiate between the sole (including the heel) and the upper (also, traditionally called the "vamp") of the shoe. The sole may be of various thicknesses and contours, and may exhibit different thicknesses and contours along the length of the shoe and/or even along the transverse dimension of the shoe.

The preferred extension includes little or no structure attached, or extending, to the level of the shoe sole, and includes no structure that extends to the bottom plane of the shoe (so that the extension includes no structure that extends to touch the floor when the wearer is standing flat on the floor/ground). This way, the extension does not interfere with mobility of the wearer because the wearer can move and maneuver in many ways that are desirable for sports of recreation, including tilting his/her feet slightly, without the extension touching the floor/ground.

The extension preferably has no portion or only a minimal portion, that is at the same vertical level as any part of the sole (in an orientation wherein the wearer is standing flat on a horizontal surface). For example, in FIG. 2, one may see that the entire pocket 14 is attached to the vertical side 11 of the shoe upper, and that only a very small portion 15 (preferably only 1/10 or less of the height H/diameter of the extension) extends down to a level below the top of the sole 13. Preferably, said portion 15 that extends down below the top level of the sole 13 is less than or equal to 20 percent of the height dimension of the extension, and more preferably, said portion 15 is 10 percent or less of said height dimension.

Figure 7:
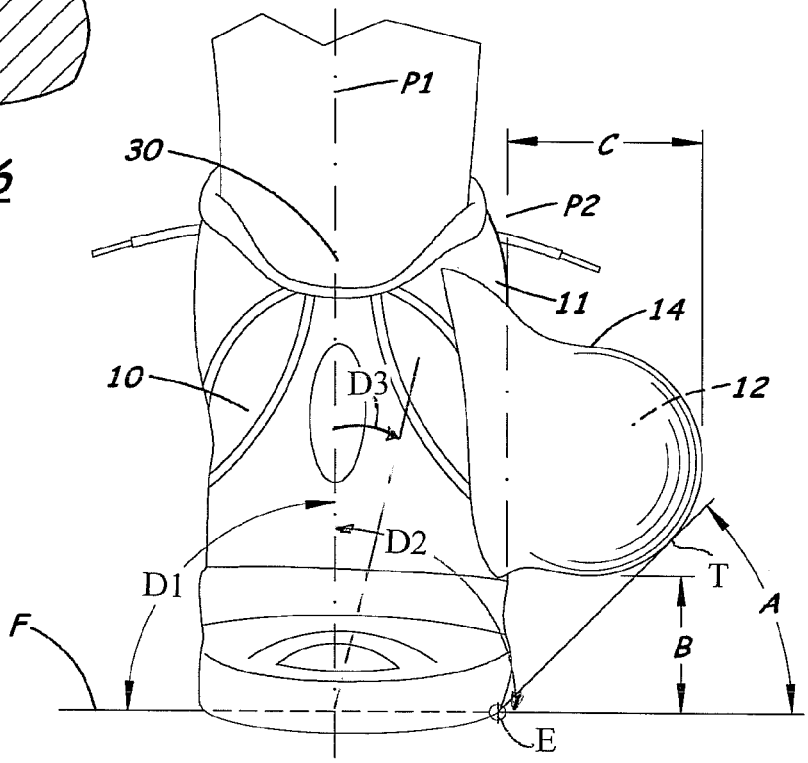
FIG. 7 is an end view of the embodiment of FIGS. 1-4 that illustrates important measurements, dimensions, and placement of preferred embodiments of the extension.

Most preferably, no part of the extension extends to, or passes through, the plane of the bottom of the sole of the shoe. In other words, no part of the preferred extension will extend to the plane of the bottom of the shoe, which, when the wearer stands flat on the floor, will be equal to the upper surface of a flat floor. Thus, it is desired that the extension not touch the floor when the wearer is standing flat on the flat floor, and it is also desired that the extension be high enough on the shoe that it will not touch the floor until the wearer's ankle has inverted a significant amount, for example, to the extent that angle D3 is 20-40 degrees (D1 is 110-135 degrees, D2 is 70-45 degrees), and, more preferably to an extent that D3 is 25-30 (D1 is 115-120 degrees, and D2=66-60 degrees). For example, the extension of FIG. 7 is sized and positioned so that it will not impact the floor until the ankle inverts to angle D3 being equal to approximately 30 degrees.

Figure 3:
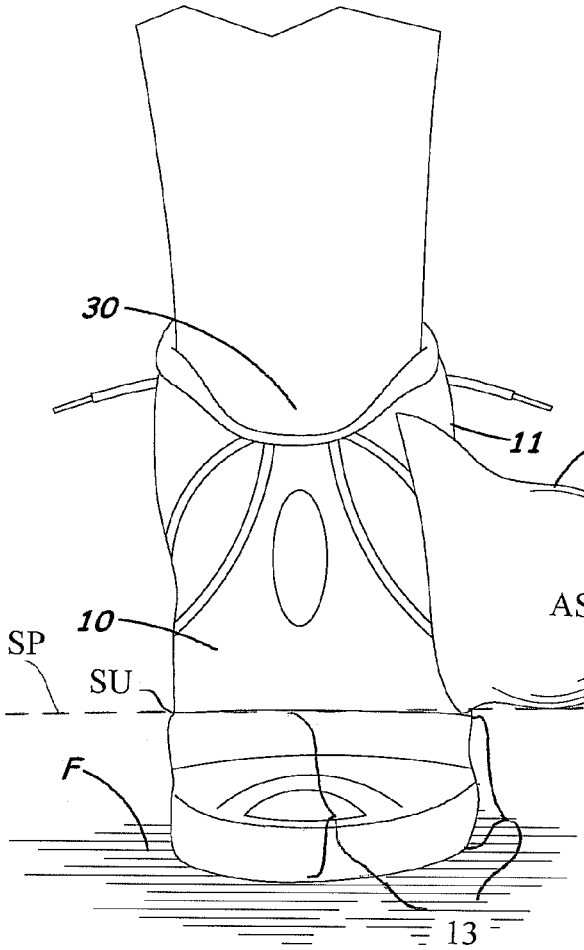
FIG. 3 is a rear view of the embodiment of FIGS. 1 and 2 being worn by a wearer who is standing flat on the floor.

Referring now to FIG. 3, the extension 1 is shown attached to an athletic shoe 10 as viewed from the rear and with ankle 30 in a normal upright position, that is, with the plane of the heel at 90 degrees to the plane of the floor (both D1 and D2 equal 90 degrees, and D3 equal to 0 degrees).

Figure 4:
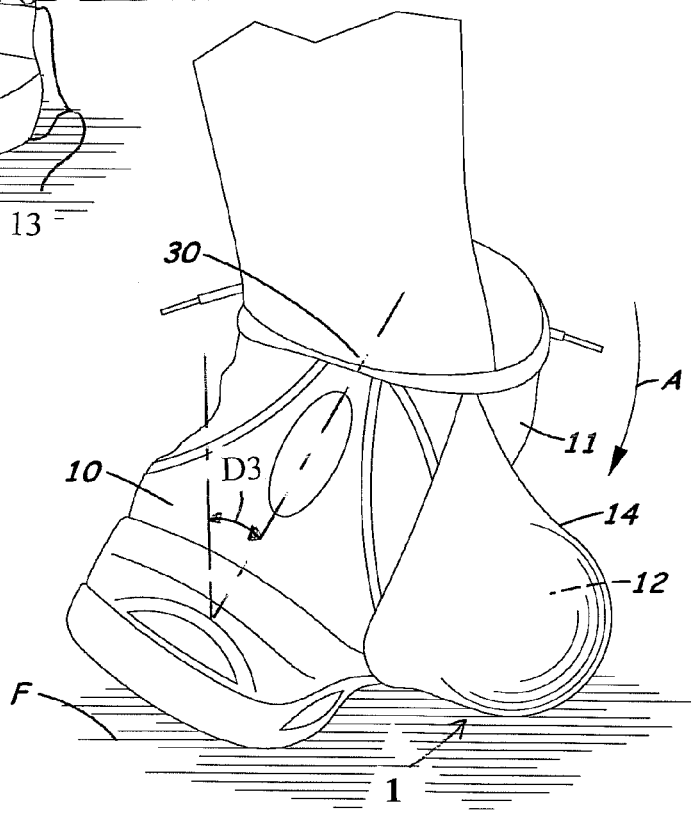
FIG. 4 is a rear view of the embodiment of FIGS. 1-3, wherein the wearer's ankle has started to invert, and has pivoted to the point wherein the extension (in this case, the insert inside the pouch) hits the floor and limits further inversion.

Referring now to FIG. 4, it will be observed that if, during athletic activity, ankle 30 is rotated/rolled out of the normal upright position, indicated by arrow A in FIG. 4, the extension 1, which comprises insert 12 within pocket 14, rotates downwardly to contact floor F, resulting in a significant slowing, and/or halt, of the rotation of ankle 30, thereby preventing a sprained or broken ankle, or at least minimizing the sprain and preventing a broken ankle. One may see from FIG. 4, that, at the time of this inversion, the leg is still generally vertical (generally perpendicular to the floor), while the plane of the heel is non-perpendicular to the plane of the floor. That is, the center plane of the heel has pivoted/rotated toward the floor, so that D3 is greater than 0 degrees and, in this view, is approximately 30 degrees.

Figure 5:
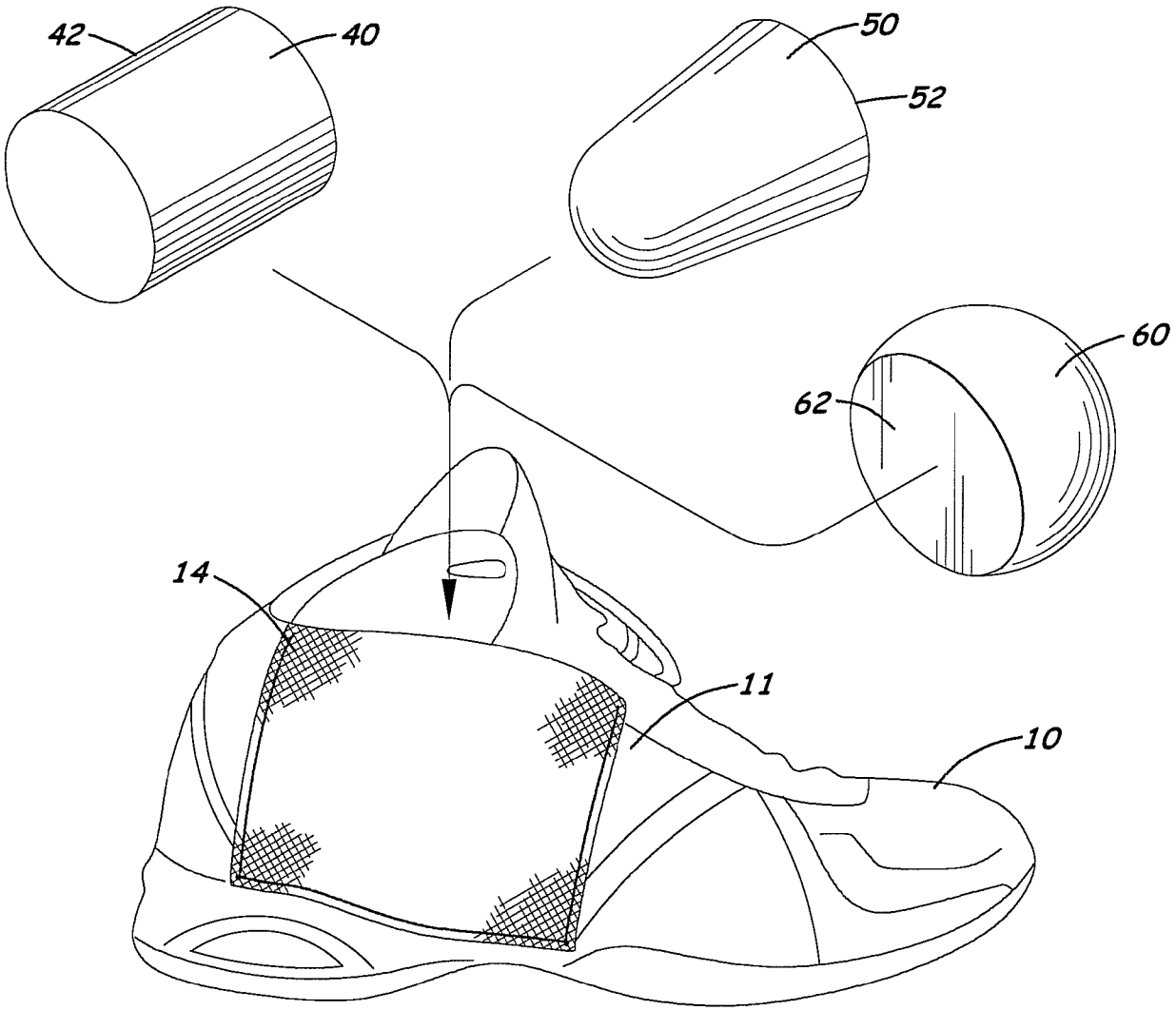
FIG. 5 is a side view of the shoe of FIGS. 1-4 and of some, but not all, alternative inserts that might be installed in the pouch on the side of the shoe upper.
Figure 6:
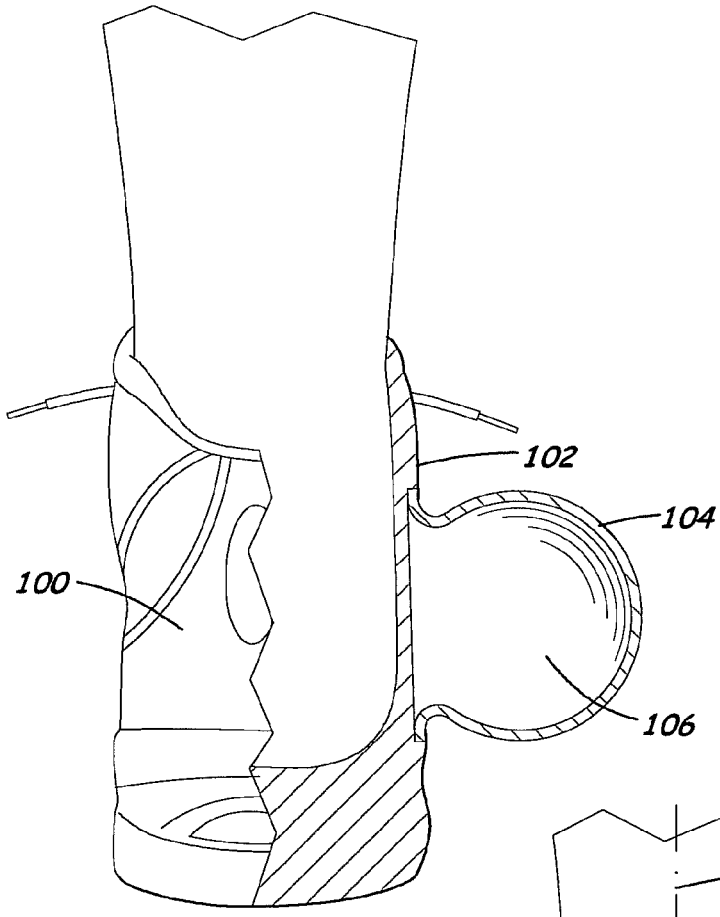
FIG. 6 is a rear view of a shoe with an alternative embodiment of extension, wherein the extension is a gas-filled member formed/molded to be generally integral with the upper around it so that the extension is manufactured as a part of the shoe, and wherein said member offers load-bearing firmness yet some cushioning and resiliency.

Referring now to FIG. 5, it will be seen that other shapes of insert/extension may be used beside the spherical insert 12. Cylindrical shape 40, rounded-end conical shape 50, or partial sphere 60 may be used, for example. While the inserts of FIG. 5 are expected to be solid forms, there may also be provided hollow versions of these forms that have wall thicknesses or materials that provide the desired firmness and resiliency/cushioning. Preferably, when cylindrical cushion 40 is used, it is inserted within pocket 14 wherein sidewall 42 contacts or is adjacent to the vertical side 11 of athletic shoe 10. Preferably, when conical cushion 50 is used, it is inserted within pocket 14 wherein base 52 contacts or is adjacent to vertical side 11 of athletic shoe 10. Partial sphere 60 may be a solid sphere from which a spherical cap has been removed to make one side surface 62 of the sphere flat for firm and certain placement against the side 11 of the shoe, so that is it base 62 that contacts or is adjacent to the side 11 of the shoe upper. Inserts having a flat or generally flat surface, such as sidewall 42, base 52, or side surface 62, are preferred in many instances, as said flat surface may be held against the vertical side 11 of the upper, for more sure, non-rolling, and non-pivoting placement of the insert. Alternatively, other shapes may be used, such as a solid or a hollow oval shape. Also, multiple, side-by-side, extensions may be used instead of the one-extension-per-shoe embodiments drawn herein.

In preferred embodiments, the portion of the extension that may typically contact/impact the floor or ground may be called the abutment surface, and it is typically positioned generally within the region marked as AS in FIG. 3, comprising the region 114 that is laterally-most-distanced from the shoe and the region that is the lateral, lower region 214, the extension being adapted so that it is these regions that are most likely to contact the floor/ground. In each of the illustrated cases, that is, a sphere, a cylinder, a round-ended cone, and a partial sphere, the outer surface of the extension/insert in the abutment region (abutment surface) has a rounded characteristic. This may be effective in making the extension "forgiving" of the exact direction at which the ankle approaches the floor/ground during an ankle inversion. This may also be effective in allowing a relatively large portion of the total extension/insert surface to be capable of impacting the floor/ground with roughly the same effect and effectiveness. In other words, with either the sphere, the rounded side wall of the cylinder, the rounded end of the cone, or the spherical surface of the partial sphere, the extension/insert may hit the floor/ground at many places on said sidewall, end, or spherical surfaces with about the same effect; there is no single point or small region of the extension or insert that must hit the floor/ground accurately in order for the device to work. The extension/insert may also "roll" slightly on the floor/ground after initial impact and still be effectively in continuing to stop further inversion. Thus, it is preferred that extension and insert outer surface be rounded, mounded, curved, convex, or spherical at least in its lower and lateral surfaces. Lateral in this context means extending out from the shoe generally perpendicular to the shoe surface and away from the body.

It is suggested by FIGS. 1-5 that the extension may be manufactured into the shoe as a pouch or other receptacle into which a selected insert may be placed and optionally removed and replaced as desired by the wearer. Also, the inventor envisions that an insert may be permanently installed and sealed inside a pouch or other receptacle rather than the insert being removable or replaceable by the wearer. Also, other structures are envisioned wherein the extension is an integral part of the shoe, without a removable insert, wherein "integral" means herein that the extension is formed as part of the shoe at the time of manufacture. In such integral extensions, the wall of the extension is preferably an integral part of the upper or at least a part that is molded, stitched, glued, or otherwise attached to the surrounding portions of the upper at the time or manufacture of the shoe. Such an integral extension may be solid, hollow, and/or partly hollow, all preferably being slightly resilient and cushioning.

One example of an integral or permanently attached extension may be a gas-filled, pressurized cushioning device that is adapted to be capable to bear a load. Said load-bearing is necessary at least during impact and contact with the floor/ground in order to support the ankle and/or foot and slow and preferably stop further inversion. One such embodiment 100 is schematically portrayed in FIG. 6, wherein a gas-filled, hollow cushion device 104 is formed so that it extends from the side 102 of the shoe. The interior cavity 106 of the gas-filled device 104 may be filled with inert or other gases, preferably pressurized above atmospheric at the time of manufacture or optionally refillable to the desired pressure, so that it substantially retains its shape and pressure during use and after multiple impacts with the floor/ground as discussed herein. Examples of technology that may be used for such a gas-filled device are load-carrying or load-bearing cushioning devices the same or similar to those described by Rudy and others in patents that are associated with Nike™ Air and Tuned Air™ technology for sports shoes. For example, see U.S. Pat. Nos. 4,219,945; 4,271,606; 4,340,626; 4,936,029; 5,042,176; and 6,013,340 for teachings regarding materials, gasses, and manufacturing methods that might be applied to forming and using a gas-containing cushioning and load-carrying device for the instant invention. Examples of materials and gas that might be effective for embodiments of the present invention are pressurized gas such as nitrogen or other preferably insert gas encapsulated in a pouch, sack, or other film member (such as polyurethane film), or other plastic rubber films/enclosures. For example, the gas-filled pouch, sack, or other film member may be a member that is separate from, but layered between or attached to, other parts of the shoe upper, or may be an integral portion of the materials of the upper that are spaced apart in a region of the upper to form an interior space for receiving said gas(es). Other structures may be used, as will be understood by one of skill in the art after viewing this disclosure and the drawings.

FIG. 7 portrays some of the angles, dimensions, and relationships that may be important in many of the embodiments of the invention. As discussed above, P1 is the plane extending centrally through the heel parallel to the longitudinal axis of the foot, wherein P1 is vertical when the wearer is standing flat on the floor/ground. When the foot begins to pivot/invert relative to the floor/ground, plane P1 is no longer vertical but rather pivots relative to the floor/ground to be at a non-perpendicular angle relative to the floor/ground. The amount of this pivot/inversion may be described as D3, and the obtuse angle between the floor and P1 may be represented by D1 (at the left of the heel plane in FIG. 7), and the acute angle between the floor and P1 may be presented by D2 (at the right of the heel plane in FIG. 7). The position of the extension in FIG. 7 may be described as being B inches above the bottom plane of the sole (which may be equated with the plane of the floor), and extending C inches outward from the plane P2 of the side of the shoe upper. As may be seen in FIG. 7, the lateral side outermost surface of generally vertical side 11 of the shoe upper is generally on vertical plane P2. Angle A may be measured from the floor to a tangent point T on the spherical surface of the extension. When the foot pivots (and therefore, the shoe and the shoe lateral side surface (11) may also be said to pivot), it will tend to pivot on the outer edge E of the sole (marked in FIG. 7 by a small circle), so that angle A will tend to become zero when the foot/ankle inverts to the extent that the extension hits the floor/ground.

In preferred embodiments, wherein the wearer is standing flat on the horizontal floor/ground, angle A is about 20-40 degrees (more preferably, 25-30 degrees), B is in the range of 0.5 or more inches (more preferably, 1-3 inches, and most preferably 1-2 inches for most shoe sizes); and C is in the range of 2-4 inches (more preferably 2.5-3 inches). The preferred width dimension (W in FIG. 2) for the extension is typically 3-4 inches from front to rear for most shoe sizes or 3-6 inches for very large shoe sizes. The preferred height dimension (H in FIG. 2) is 3-4 inches from top to bottom for most shoe sizes or 3-6 inches for very large shoe sizes. In the cases wherein the insert or extension is a sphere or a sphere with a spherical cap removed, the preferred diameter of the sphere/partial sphere is in the range of 2.5-3.5 inches.

While all the embodiments shown herein involve attachment to, or integral extension from a shoe, some embodiments may be developed that comprise straps, sleeves, or hook-and-hoop fasteners, or other connections that allow an extension(s) to be added to a conventional shoe. Also, the preferred shoe is an adult shoe (for example, in a men's size range of 6-13), and, hence the preferred dimensions and measurements are for an adult shoe in this size range. The system may be scaled up for very large shoes (for example, men's sizes larger than 13) and may be scaled down for children's shoes and other small shoes (youth sizes smaller than 6).

Although this invention has been described above with reference to particular means, materials and embodiments, it is to be understood that the invention is not limited to these disclosed particulars, but extends instead to all equivalents within the scope of the following claims.

The invention claimed is:

1. A system for limiting foot inversion for limiting ankle sprains, said system comprising:

a shoe having an upper with a lateral side outermost surface that is generally on a vertical plane when a wearer of the shoe stands on a horizontal floor or ground, and wherein the shoe has a sole with a bottom having a bottom plane that is horizontal when the wearer stands on said horizontal floor or ground;

an extension protruding at least 2 inches perpendicularly outward from said vertical plane and having an abutment surface adapted to impact said floor or ground when the wearer's foot inverts to move said lateral side surface toward said floor or ground;

wherein the lowermost surface of the extension is 0.5 or greater inches above the bottom plane of the bottom of the sole, and the extension has no portion that extends down to said bottom plane of the bottom of the sole.

2. A system as in claim 1, wherein said extension is adapted to impact said floor or ground when the wearer's foot inverts to an extent within the range of 20-40 degrees from vertical.

3. A system as in claim 1, wherein the entirety of the extension is located 1 inch or more above said bottom plane.

4. A system as in claim 1, wherein the extension protrudes laterally from said vertical plane a distance in the range of 2-4 inches.

5. A system as in claim 1, wherein said extension is a spherical shape having a convex abutment surface.

6. A system as in claim 1, wherein said extension is a cylindrical shape having a curved abutment surface.

7. A system as in claim 1, wherein said extension is a partial sphere shape having a convex abutment surface.

8. A system as in claim 1, wherein said extension comprises a pocket on said lateral side surface and an insert installed inside said pocket.

9. A system as in claim 1, wherein said extension is integral with said lateral side surface.

10. A system as in claim 1, wherein said extension comprises a member selected from the group consisting of: a polystyrene foam sphere, a solid rubber ball, a hollow rubber ball, a closed cell foam member, a solid cylinder, a hollow cylinder, a solid rounded-end cone, a hollow rounded-end cone, a solid partial sphere, and a hollow partial sphere, an oval member, a hollow member containing gas at a pressure higher than the atmosphere around the shoe, and a hollow pocket in an upper of the shoe containing gas at a pressure higher than the atmosphere around the shoe.

* * * * *